United States Patent [19]

Wehler

[11] 4,174,908

[45] Nov. 20, 1979

[54] PRINTER COMPRISING A PRINTING HEAD CONTROLLED BY A SENSOR

[75] Inventor: Herbert Wehler, Neunkirchen, Fed. Rep. of Germany

[73] Assignee: U.S. Philips Corporation, New York, N.Y.

[21] Appl. No.: 851,891

[22] Filed: Nov. 16, 1977

[30] Foreign Application Priority Data

Nov. 13, 1976 [DE] Fed. Rep. of Germany ..... 2651884

[51] Int. Cl.[2] ..... B41J 3/12; B41J 11/20

[52] U.S. Cl. ..... 400/56; 400/124; 73/DIG. 2

[58] Field of Search ..... 400/55-60, 400/124; 73/DIG. 2

[56] References Cited

U.S. PATENT DOCUMENTS

| | | | |
|---|---|---|---|
| 2,643,367 | 6/1953 | Cruzan | 73/DIG. 2 |
| 3,017,575 | 1/1962 | Dubský et al. | 73/DIG. 2 |
| 3,705,408 | 12/1972 | Krone et al. | 346/139 C |
| 3,750,792 | 8/1973 | Liles | 400/124 |
| 3,981,235 | 9/1976 | Thomas et al. | 400/56 |
| 4,024,940 | 5/1977 | Hendrischk et al. | 400/59 |
| 4,088,215 | 5/1978 | Bader | 400/59 |

FOREIGN PATENT DOCUMENTS

| | | | |
|---|---|---|---|
| 2608301 | 8/1977 | Fed. Rep. of Germany | 400/56 |

OTHER PUBLICATIONS

AeroVox Research Worker, *Applications of Hall Effect and Magnetoresistance*, vol. 36, Nos. 1-12, 1-12/1966.

*Forms Sensor for Automatic Platen*, Carpenter et al., IBM Technical Disclosure Bulletin, vol. 13, No. 12, p. 3643, 5/71.

*Primary Examiner*—William Pieprz

*Attorney, Agent, or Firm*—Robert S. Smith

[57] ABSTRACT

A printer comprising a carriage which is displaceable along a record carrier and on which a printing head is arranged to be slidable independently of the carriage. The carriage is provided with a sensor for controlling the distance between the printing head and the record carrier.

7 Claims, 5 Drawing Figures

PRINTER COMPRISING A PRINTING HEAD CONTROLLED BY A SENSOR

Figure 1:
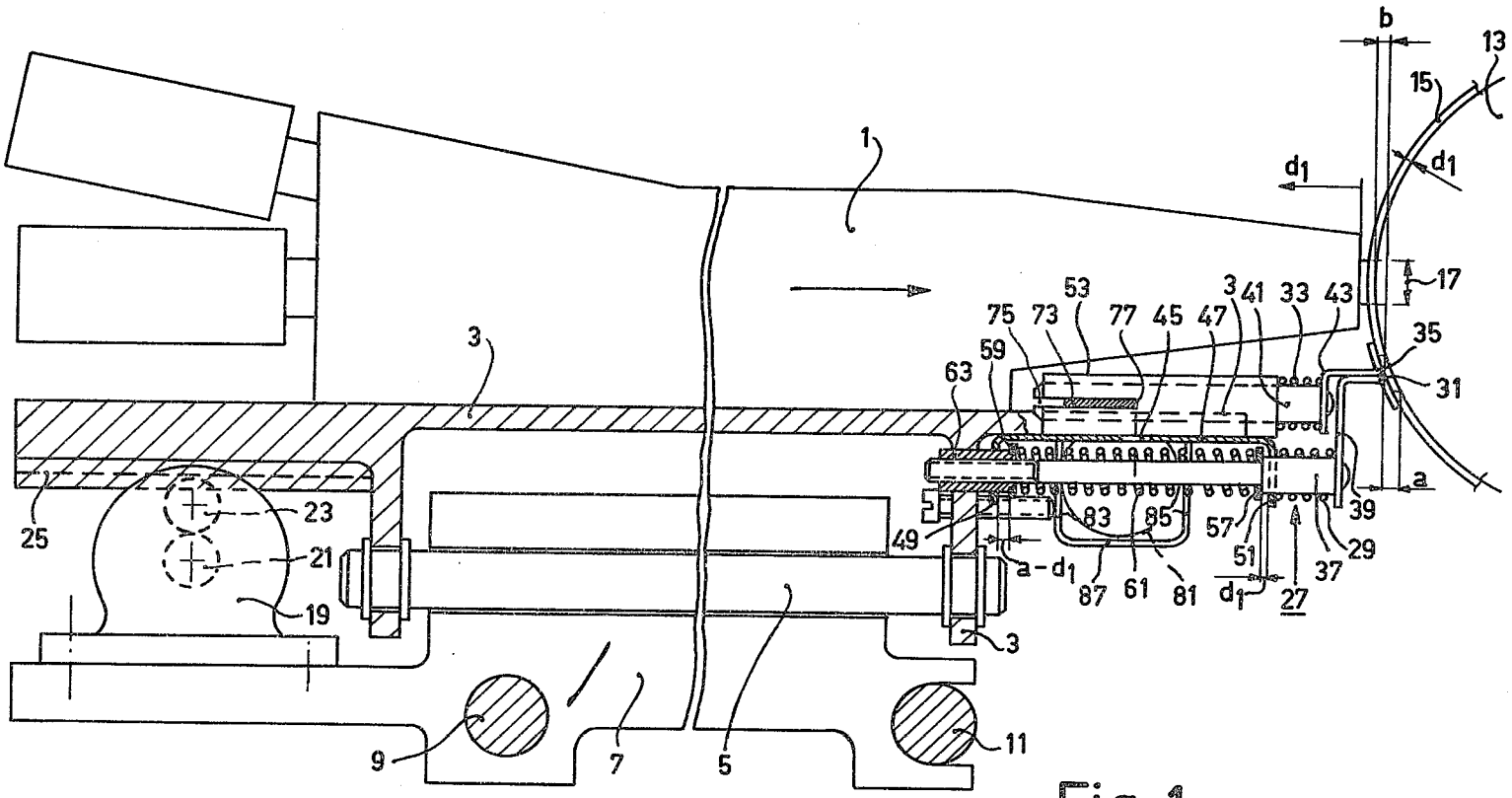

The invention relates to a printer, comprising a carriage which is displaceable in the printing direction along a record carrier, a printing head being mounted on said carriage to be slidable in a direction transverse to the printing direction, independently of the carriage movement, and also comprising a sensor which is displaced in synchronism with the carriage and which is biased against the record carrier, said sensor serving to determine the thickness of the record carrier and being coupled to the printing head in order to maintain a constant, predetermined distance between printing head and record carrier.

In a printer of the described kind, known from U.S. Pat. No. 3,750,792, the sensor is mounted to be stationary on the printing head which is displaceable in a direction transverse to the carriage. The printing head is biased against the record carrier by means of a spring connected to the carriage. The necessary constant distance between printing head and record carrier is maintained in that the sensor occupies a fixed position with respect to the printing head. Because the effect of reaction forces on the printing head during printing must be prevented in a printer of this kind, the bias of said spring is chosen to be so large that the sensor remains in pressure contact with the record carrier in all circumstances. The required bias is comparatively large and may cause undesired imprints of the sensor on the record carrier. Moreover, the mode of transport of the record carrier is actually limited to intermittent transport, because continuous transport is impeded by the sensor which is subject to a comparatively large bias.

The invention has for its object to provide a printer comprising a sensor which is biased against the record carrier, but in which the bias of the sensor is in principle independent of the reaction forces on the printing head and the mass of the printing head.

To this end, a printer in accordance with the invention is characterized in that the sensor is arranged to be relatively movable on the carriage and comprises a mechanical/electrical converter, an output signal of which, being proportional to the thickness of the record carrier, is supplied to an electric motor which is arranged in a mechanical drive for the printing head in order to realize a displacement of the printing head relative to the carriage which is equal to the sensed thickness of the record carrier.

A special embodiment of a printer in accordance with the invention, being extremely suitable for printing on comparatively rigid record carriers, moreover, is characterized in that the sensor comprises a first follower which is biased against the record carrier and which is relatively displaceable with respect to the carriage, and also comprises a second follower which is biased against the record carrier and which is relatively displaceable with respect to the first follower, a mechanical part of the mechanical/electrical converter being coupled to the one follower, while an electrical part of the converter is coupled to the other follower.

The invention will be described in detail hereinafter with reference to the accompanying diagrammatic drawing.

Figure 2:
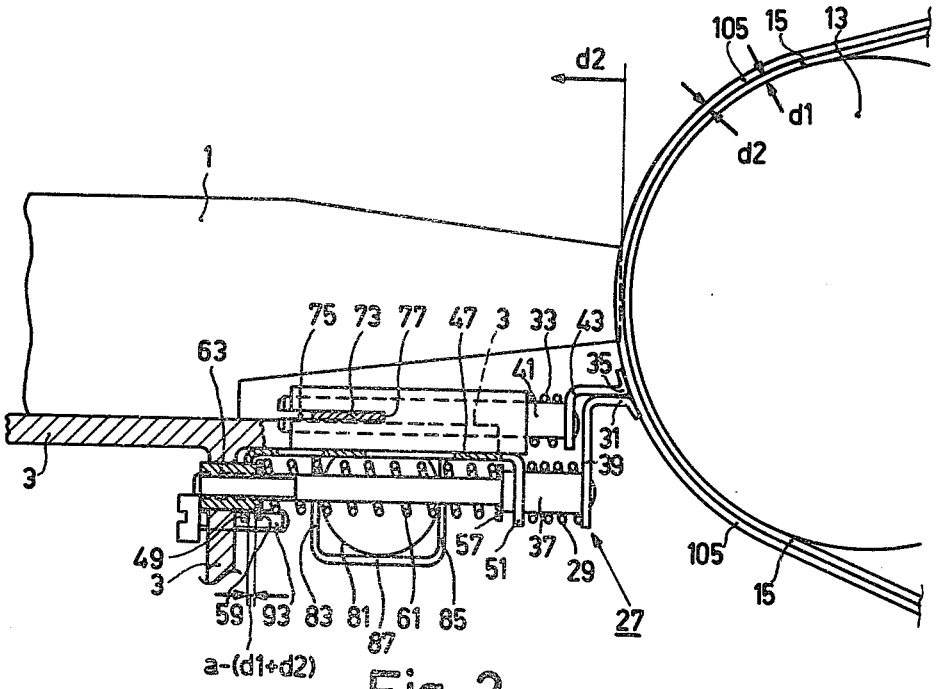
Figure 3:
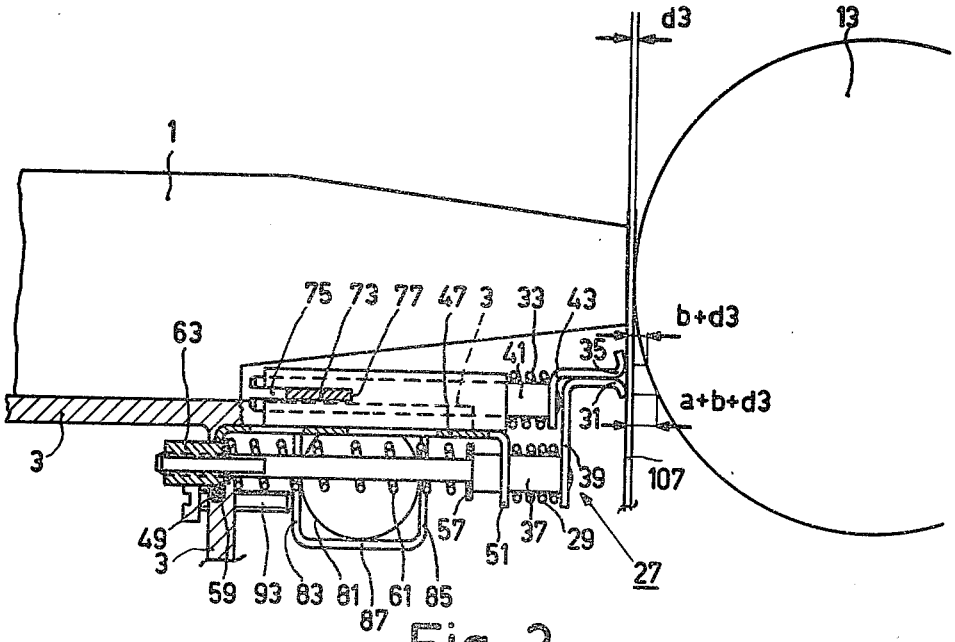
Figure 4:
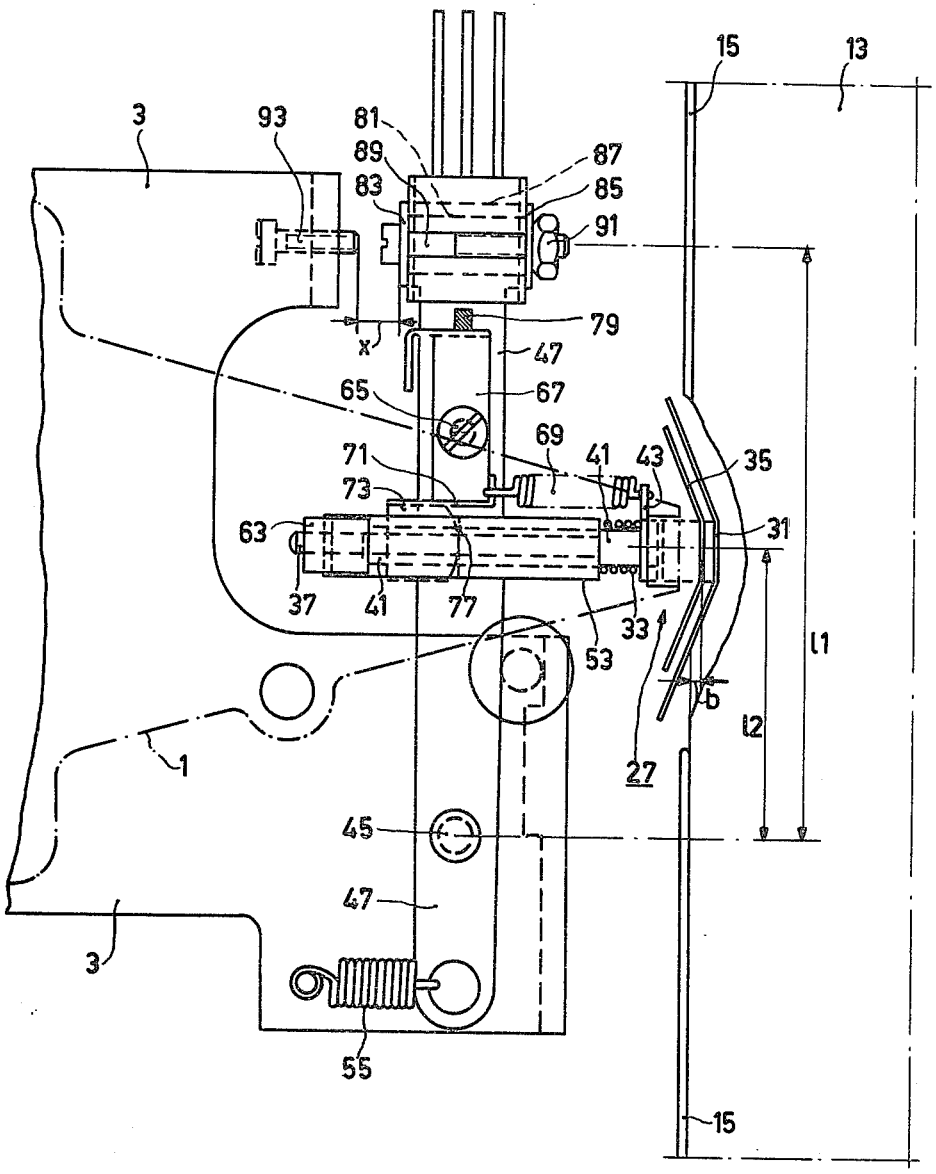
Figure 5:
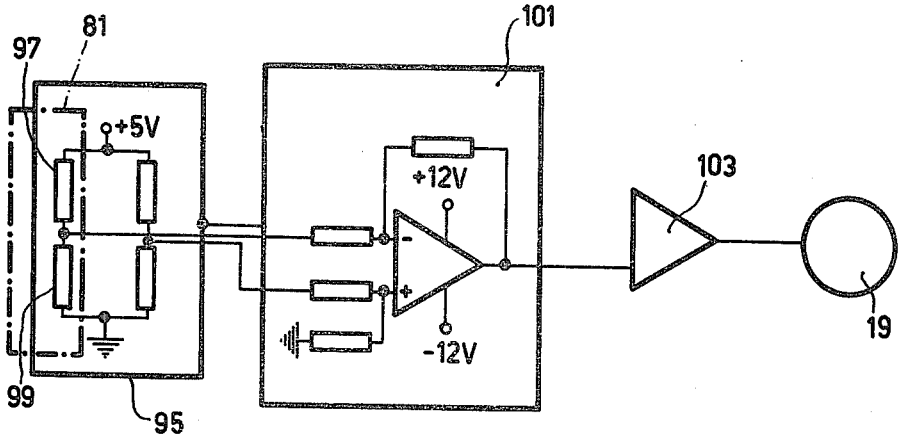

FIG. 1 is a side elevation of a special embodiment of a printer in accordance with the invention during the printing on a record carrier having a thickness $d_1$, FIG. 2 shows a part of the printer shown in FIG. 1 during the printing on a combination of a record carrier having the thickness $d_1$ and a record carrier having a thickness $d_2$, FIG. 3 shows a part of the printer of FIG. 1 during the printing on a comparatively rigid record carrier having a thickness $d_3$, FIG. 4 is a plan view of a part of the printer shown in FIG. 1, and FIG. 5 is a block diagram of a control circuit for the electric motor which includes the mechanical/electrical converter.

The printer shown in FIG. 1 comprises a printing head 1 of a known kind, that is to say a so-termed matrix printing head comprising printing styli which are actuated by electromagnets. Therefore, the printing head 1 is only diagrammatically shown. However, the invention is by no means restricted to printers comprising so-termed matrix printing heads. Generally, the invention can be used in printers where a constant distance must be maintained between printing head and record carrier, and also in printers where it must be possible to adapt the impact of the printing elements to the (overall) thickness of the record carrier (carriers). Examples in this respect are printers comprising electrostatic printing heads and printers comprising printing elements which comprise the entire character to be printed (type printers).

The printing head 1 is mounted on a transverse carriage 3 which can be displaced, by means of a guide rod 5, with respect to a longitudinal carriage 7. The longitudinal carriage 7 it displaceable on two parallel guide rods 9 and 11. The motor drive required for this purpose is of a commonly used type (not shown). The guide rods 9 and 11 are parallel to a cylindrical anvil 13 which horizontally extends in the printing direction. The printing direction is to be understood to mean herein the direction of a line printed on a record carrier 15, and also the directions parallel thereto. The flexible record carrier 15 is partly bent around the anvil 13, having a circular cross-section, and is further guided in a transport device of a commonly used type which is not shown. Because the printing head 1 is displaceable with respect to the longitudinal carriage 7 in a horizontal plane, perpendicularly to the direction of the guide rods 9 and 11, the movement direction of the printing head 1 extends perpendicularly to the tangent plane to the anvil 13 or the record carrier 15 at the area of printing. The printing position is diagrammatically denoted by a reference numeral 17. On the longitudinal carriage 7 there is provided an electric motor 19, comprising a driven pinion 21 which engages, via a gearwheel 23, a toothed rack 25 provided on the transverse carriage 3. The direction of rotation of the motor 19 can be reversed. The motor 19 is controlled by a signal which originates from a sensor to be described hereinafter. This sensor supplies a signal which is proportional to the thickness $d_1$ of the record carrier 15, so that the motor 19 can effect a transverse displacement of the printing head 1 with respect to the longitudinal carriage 7 which is equal to $d_1$. Assuming that the distance in FIG. 1 between the right end of the printing head 1 and the tangent plane to the anvil 13 at the printing position 17 is the required printing distance, the printing head 1 must then be displaced to the left over the distance $d_1$ (see arrow). Printing distance is to be understood to mean herein the distance between the printing head and the record carrier which results in optimum printing quality. In practice, this distance is an invariable for each type of printing head.

The sensor 27 shown in the FIGS. 1 and 4 comprises a first follower, shaped as a sliding shoe 31, which is biased against the record carrier 15 by a helical spring 29, and a second follower, also shaped as a sliding shoe 35, which is biased against the record carrier by a helical spring 33. The sliding shoe 31 is connected to a shaft 37 by way of a bracket 39, the sliding shoe 35 being connected to a shaft 41 by way of a bracket 43. A pivotable arm 47, having a U-shaped cross-section, mounted on the transverse carriage 3 to be rotatable about a shaft 45 (FIG. 4). The pivotable arm 47 serves as a support for the shafts 37 and 41. To this end, the lower side of the pivotable arm 47 comprises fitting openings for guiding the shaft 37, provided in the legs 49 and 51, while on the upper side of the pivotable arm 47 a sleeve 53 is mounted for guiding the shaft 41. The shaft 37 as well as the shaft 41 is supported by the pivotable arm 47, and hence also the sliding shoes 31 and 35. The pivotable arm 47 is rotatable counter-clockwise against the force of a tension spring 55 (see FIG. 4). On the shaft 37 there is provided an annular flange 59 which bears against a shoulder on the shaft. Between the flanges 57 and 59 a compression spring 61 is arranged around the shaft 37. The spring 61 presses the flange 59 against an adjustable threaded bushing 63 which is screwed onto the shaft 37 and which is journalled to be slidable in an opening in the leg 49 of the pivotable arm 47. The distance between the flange 59 and the leg 49 can be adjusted by the turning of the threaded bushing 63. On the first pivotable arm 47 there is provided a second pivotable arm 67 which is rotatable about a shaft 65 (FIG. 4). The pivotable arm 67 is rotatable clockwise against the force of a tension spring 69, one end of which is connected to the second pivotable arm 67, its other end being connected to the bracket 43. The second pivotable arm 67 is provided with a corner piece 71 which comprises a flap 73 which is disposed at a right angle to the main portion of arm 63. The flap 73 of the corner piece 71 is guided in a slot 75 (see FIG. 1) provided in the bushing 53. The tension spring 69 always keeps the flap 73 pressed against a shoulder 77 on the shaft 41 which acts as an abutment (diagrammatically denoted in FIG. 4 by a broken line). On the end which is remote from the corner piece 71, the second pivotable arm 67 is provided with a so-termed mechanical part of a mechanical/electrical converter. In the present case, this mechanical part of the converter consists of a piece of soft iron 79. The electrical part of the mechanical/electrical converter comprises a magnetoresistor 81, that is to say a resistor whose resistance is dependent on the magnitude and the direction of a magnetic control field, which is connected to the first pivotable arm 47. The magnetoresistor 81 is of a known type comprising two resistance plates of semiconductor material which are magnetically biased by a common permanent magnet and which are electrically connected in series. The intensity of the magnetic control field is linearly dependent on the position of the piece of soft iron 79 with respect to the magnetoresistor 81. The disk-shaped magnetoresistor 81 is clamped between the legs 83 and 85 of a U-shaped clamp 87 provided on the first pivotable arm 47. The legs 83 and 85 are pulled towards each other by means of a tension bolt 89 which is interserted through the clamp and which is tensioned by a nut 91 (see FIG. 4). On the transverse carriage 3 there is provided an adjustable stop in the form of a screw 93 for the first pivotable arm 47. For each relative displacement of the piece of soft iron 79 with respect to the magnetoresistor 81, a signal which is proportional to this displacement is generated in the magnetoresistor. This signal is processed in the known control circuit which is shown in the form of a block diagram in FIG. 5 and which comprises a Wheatstone bridge 95 which includes the two resistance plates present in the magnetoresistor 81. These resistance plates are denoted by the reference numerals 97 and 99 in FIG. 5. The difference signal originating from the Wheatstone bridge is supplied to a known differential amplifier 101 and subsequently to an amplifier 103. The signal supplied by the amplifier 103 is used for controlling the electric motor 19. The displacement of the printing head 1 with respect to the transverse carriage 3, effected by the motor 19, is equal to the change in the thickness of the record carrier sensed by the sliding shoes 31 and 35, for example, the thickness variation of the record carrier 35 itself. The operation of the sensor 27 will be described in detail hereinafter, notably with reference to the FIGS. 1, 2 and 3 which show different situations which occur during the printing of record carriers.

In the case shown in FIG. 1, a record carrier 15, having a thickness $d_1$, is bent around the anvil 13. Usually, the longitudinal carriage with the guide rods 9 and 11 is arranged to be tiltable (not shown), so that the record carrier 15 can be simply inserted. It is assumed that the distance between the sliding shoes 31 and 35 equals a, as shown in FIG. 1, due to the curvature of the anvil 13. The distance a is measured in the plane of the drawing. Actually, the distance between the sliding shoes 31 and 35 is negligibly smaller than a which is due to the insertion of the record carrier 15. This is because the curvature at the area of the sliding shoes 31 and 35 is slightly smaller when the record carrier is present than when the sliding shoes contact a bare anvil. It is also assumed that the distance between the leg 49 of the pivotable arm 47 and the flange 59 is adjusted, by means of the adjusting screw 63, so that it amounted to a prior to the insertion of the record carrier. After insertion of the record carrier, said distance amounts to $a-d_1$, as is shown in FIG. 1 ($a>d_1$). The springs 29 and 33 are compressed over a length $d_1$ by the insertion of the record carrier, because the spring constants of the springs 55 (FIG. 4) and 61 (FIG. 1) are chosen to be so high that only a relative displacement equal to $d_1$ occurs between the shaft 37 and the pivotable arm 47. Consequently, the position of the pivotable arm 47 is not changed by the insertion of the record carrier. Because the shaft 41 has been displaced to the left over a distance $d_1$ after insertion of the record carrier (relatively with respect to the pivotable arm 47), the piece of soft iron 79 has been relatively displaced over a distance $d_1$ with respect to the magnetoresistor mounted on the stationary pivotable arm 47. To this end, the shortest distance between the soft iron 79 and the pivot shaft 65 has been chosen to be equal to the shortest distance between the shaft 41 and the pivot shaft 65. The resistance variation in the magnetoresistor 81 caused by the relative displacement over $d_1$ of the piece of soft iron 79, is converted in the described manner to form a control signal for the motor 19. During the movement of the printing head 1 to the left (see arrow denoted by $d_1$ in FIG. 1), the relative displacement between the second pivotable arm 67 and the first pivotable arm 47 gradually decreases to zero, so that the printing head 1 is ultimately displaced to the left over a distance $d_1$. Obviously, it is assumed that the distance between the printing head 1 and the anvil 13 in FIG. 1 is the desired printing distance, so that the correct printing distance is obtained again after the displacement to the left over the distance $d_1$. The operation of the sensor 27 is identical to the described operation in a situation where the printing head—travelling from left to right along the anvil (perpendicularly to the plane of the drawing)—must suddenly handle a thickness $d_1$ of a record carrier, being substantially narrower than the anvil, after having initially slid over a bare anvil. Thickness variations in the record carrier itself are also compensated for by means of the described servo system.

The situation shown in FIG. 2, often occurring in practice, is characterized by the presence of a record carrier 15 having a thickness $d_1$ and a record carrier 105 having a thickness $d_2$. The width of the record carriers 15 and 105 differs and they partly overlap. Assuming that during its movement from left to right along the anvil 13 (perpendicularly to the plane of the drawing), the printing head must first print on the record carrier 15, having the thickness $d_1$, and subsequently on the record carrier 105, having the thickness $d_2$, the sensor 27 will have to deal with a jump equal to $d_2$ during printing. This jump $d_2$ is dealt with in the same way as the jump $d_1$ of the preceding case, if the relation $a > d_1 + d_2$ is satisfied. The distance a may also be considered as the loose stroke of the shaft 37 with respect to the pivotable arm 47. During the printing on the record carrier 105, the printing head has thus being displaced to the left over the distance $d_1 + d_2$. The sliding shoes 31 and 35 are preferably shaped as a trapezium (see FIG. 4) in order to enable printing on the record carrier 15 as far as the vicinity of the jump to the record carrier 105.

A very special case of sensing occurs in the situation shown in FIG. 3. In practice, the printing on comparatively rigid record carriers, such as account cards, occurs substantially frequently. Assuming that the total spring pressure exerted by the sensor 27 on a rigid record carrier 107, having a thickness $d_3$, is comparatively small, the situation shown in FIG. 3 arises. In this case, the rear of the record carrier 107 is situated in the vertical tangent plane to the anvil at the printing area. If necessary, an additional anvil may be arranged between the record carrier 107 and the anvil 13. Actually, in that case the same situation arises as in the case of printing on flexible and/or rigid record carriers which are passed over a straight (non-curved) anvil. The total absolute displacement of the sliding shoe 31 amounts to $a + b + d_3$, the distance a also being the maximum relative displacement of the shaft 37 with respect to the pivotable arm 47 (see FIG. 1). The total absolute displacement of the sliding shoe 35 amounts to $b + d_3$. The distance b is the shortest distance between the vertical tangent plane to the anvil and the plane, extending parallel thereto, through the point of contact of the sliding shoe 35 with the bare anvil. After the sliding shoe 31, and hence the shaft 37, has been displaced over a distance a with respect to the first pivotable arm 47, the flange 59 abuts against the leg 49 of the first pivotable arm 47. The part b of the total displacements of the sliding shoes 31 and 35 causes rotation of the pivotable arm 47 over a distance X (FIG. 4) which satisfies the relation $X = (l_1/l_2) \cdot b$. The distance X is adjusted by means of the adjusting screw 93 for this purpose. Therefore, during the displacement over the distance b no control signal is generated for the motor. The part $d_3$ of the total displacements of the sliding shoes takes place while the stationary pivotable arm 47 bears against the adjusting screw 93. The spring 61 is then slightly compressed. The second pivotable arm 67, however, performs a relative displacement with respect to the first pivotable arm 47 at the area of the shaft 41, said displacement being equal to the thickness $d_3$ of the record carrier 107. Because the piece of soft iron then also performs a displacement $d_3$ with respect to the magnetoresistor 81, a control signal proportional to $d_3$ is applied to the motor 19. Consequently, the printing head 1 is moved to the left over a distance $d_3$.

Even though the invention has been described with reference to a printer comprising a sensor which includes rotatable followers (pivotable arms), translating followers can also be used. The sensor comprising two, followers which are relatively movable with respect to each other is particularly suitable for the printing on account cards. However, if no account cards need be printed, it suffices to use only one rotatable or translating follower which is mounted on the transverse carriage and which can perform a relative movement with respect thereto.

For the mechanical/electrical converter, use can actually be made of any converter whereby a relative movement can be translated into a signal for controlling an electric motor.

The signal generated by the sensor may also be used for the automatic control of the impact which is inter alia dependent of the number of copies to be printed.

What is claimed is:

1. A printer which comprises:

a carriage which is displaceable in the printing direction along an associated record carrier, a printing head carried on said carriage for sliding movement in a direction transverse to the printing direction independently of any carriage movement, a sensor which is displaced in sychronism with said carriage and which is biased against the associated record carrier, said sensor serving to determine the thickness of the associated record carrier and being coupled to said printing head in order to maintain a constant, predetermined distance between said printing head and the associated record carrier, said sensor comprising a mechanical/electrical converter having an output signal which is proportional to the thickness of the associated record carrier, said sensor comprising a first follower which is biased against the associated record carrier and which is relatively displaceable with respect to said carriage, and a second follower which is biased against the associated record carrier and which is relatively displaceable with respect to said first follower, a mechanical part of said mechanical/electrical converter being coupled to said first follower and an electrical part of said converter being coupled to said second follower, and an electric motor connected to said converter to receive said output signal and a mechanical drive for said printing head cooperating with said printing head to displace said printing head relative to said carriage a distance which is equal to the sensed thickness of said record carrier.

2. A printer as claimed in claim 1 wherein said printer includes a support which is itself relatively displaceable with respect to said carriage, said first follower being mounted to be relatively displaceable on said support, said carriage being provided with an abutment for said support.

3. A printer as claimed in claim 2 wherein said support for said first follower comprises a first pivotable arm which is mounted on said carriage and which is rotatable, said support further including a first spring biasing said first pivotable arm in one rotational direction, said second follower being coupled to said first pivotable arm by means of a second pivotable arm which is rotatable with respect thereto, said printer further including a second spring biasing said second pivotable arm in one angular direction.

4. A printer as claimed in claim 3 wherein said first pivotable arm comprises an adjustable abutment for said first follower.

5. A printer as claimed in claim 3 wherein said second follower is guided in said first pivotable arm.

6. A printer as claimed in claims 1, wherein the mechanical part of said mechanical/electrical converter comprises a magnetic conductor which is connected to said second pivotable arm, the electrical part of said converter comprising a magnetoresistor.

7. A printer as claimed in claim 1 wherein said electrical part of said converter forms part of a control circuit.

* * * * *